US011506465B1

(12) United States Patent
Foltz et al.

(10) Patent No.: US 11,506,465 B1
(45) Date of Patent: Nov. 22, 2022

(54) APPARATUS AND METHODS FOR DISRUPTING/DISABLING EXPLOSIVE ORDNANCE

(71) Applicant: The United States of America as Represented by the Secretary of the Navy, Indian Head, MD (US)

(72) Inventors: Lee Foltz, Indian Head, MD (US); Adam J. Pegouske, White Plains, MD (US); Daniel McCarthy, LaPlata, MD (US); George R. Torres, Hughesville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/873,856

(22) Filed: Jul. 30, 2020

(51) Int. Cl.

| | |
|---|---|
| ***F41B 9/00*** | (2006.01) |
| ***F42B 33/06*** | (2006.01) |
| ***F42D 5/04*** | (2006.01) |
| ***F42D 3/00*** | (2006.01) |
| ***F42D 1/04*** | (2006.01) |
| ***F42B 3/00*** | (2006.01) |
| ***F42B 3/24*** | (2006.01) |
| ***F42B 3/02*** | (2006.01) |

(52) U.S. Cl.
CPC ..... *F41B 9/0046* (2013.01); *F42B 3/00* (2013.01); *F42B 3/24* (2013.01); *F42B 33/06* (2013.01); *F42D 1/043* (2013.01); *F42D 3/00* (2013.01); *F42D 5/04* (2013.01); *F42B 3/02* (2013.01)

(58) Field of Classification Search
CPC ..... F42B 3/00; F42B 3/02; F42B 3/24; F42B 33/06; F42D 3/00; F42D 3/04; F42D 5/04; F42D 1/00; F42D 1/04; F42D 1/043; F42D 3/02; F41B 9/00; F41B 9/0046
USPC ..... 86/50; 102/317, 331, 301, 314, 322, 332
See application file for complete search history.

(56) References Cited

U.S. PATENT DOCUMENTS

| | | | | | |
|---|---|---|---|---|---|
| 3,354,827 | A | * | 11/1967 | Nelson | F42B 3/00 102/318 |
| 3,438,325 | A | * | 4/1969 | Martin | F42B 3/00 102/314 |
| 3,926,119 | A | * | 12/1975 | Hurst | F42B 3/02 102/317 |
| 3,955,504 | A | * | 5/1976 | Romney | F42B 3/00 102/306 |
| 4,015,526 | A | * | 4/1977 | Bond | F42B 3/02 181/118 |
| 4,126,239 | A | | 11/1978 | Gehrig | |
| 4,348,955 | A | | 9/1982 | Rowley | |

(Continued)

FOREIGN PATENT DOCUMENTS

| | | | | |
|---|---|---|---|---|
| CN | 201555529 U | * | 8/2010 | F41B 9/0046 |
| DE | 3321357 A | * | 12/1984 | F42B 3/00 |

*Primary Examiner* — James S Bergin
(74) *Attorney, Agent, or Firm* — Fredric J. Zimmerman

(57) ABSTRACT

Explosive devices may be formed from hollow members filled with explosive materials. The hollow members may be made of mating halves that are packed or loaded with explosive material prior to the mating halves being joined together. In some exemplary aspects, the hollow members are placed in fluid-filled containers such that the explosive reaction creates a wave of fluid that impacts a target. Components of the devices may be COTS items and items that may be manufacture with 3D printers.

52 Claims, 16 Drawing Sheets

(56) References Cited

U.S. PATENT DOCUMENTS

| | | | | |
|---|---|---|---|---|
| 5,435,250 | A * | 7/1995 | Pollock | F42D 1/22 102/317 |
| 5,798,477 | A * | 8/1998 | Givens | F42B 3/26 102/302 |
| 5,959,237 | A * | 9/1999 | Clement | F42B 33/0214 102/317 |
| 6,269,725 | B1 | 8/2001 | Cherry | |
| 6,739,265 | B1 * | 5/2004 | Badger | F42B 1/00 102/275.12 |
| 9,133,072 | B1 * | 9/2015 | Strong | F41H 11/14 |
| 9,322,624 | B2 | 4/2016 | Alford et al. | |
| 9,470,499 | B2 | 10/2016 | Benson | |
| 2007/0209500 | A1 | 9/2007 | Wilber | |
| 2019/0063892 | A1 * | 2/2019 | Brown | F42D 1/043 |

* cited by examiner

APPARATUS AND METHODS FOR DISRUPTING/DISABLING EXPLOSIVE ORDNANCE

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates in general to Explosive Ordnance Disposal (EOD) and in particular to improved apparatus and methods for disrupting explosive devices.

BACKGROUND OF THE INVENTION

Conventional technologies for disabling or disrupting explosive ordnance include water systems that use high explosive to propel the water. The targeted explosive ordnance may include, for example, bombs, Improvised Explosive Devices (IEDs) or other explosive devices. The acquisition, production, maintenance and disposal of EOD gear and tools are often logistically complex and time-consuming.

A need exists for EOD gear and tools that are simple enough to be manufactured using COTS (commercial off the shelf) components and/or additive manufacturing techniques, such as three-dimensional (3D) printing.

SUMMARY OF THE INVENTION

In a first aspect, an explosive device includes a hollow cylindrical tube having a mating pair of semi-cylindrical halves. The tube has opposing ends of lesser outside diameter than an outside diameter of the remainder of the tube. The tube may include a pair of spaced-apart flanges formed on an interior surface thereof. Each flange may include a central opening therein. The tube may include first and second sleeves disposed over the lesser diameter opposing ends of the tube to hold the semi-cylindrical halves together. Explosive material may be disposed in the hollow cylindrical tube between the pair of spaced-apart flanges.

A length of detonation cord may extend from inside one of the pair of spaced-apart flanges, through the central opening of the one of the pair of flanges and through one of the first and second sleeves to a point that is exterior to the explosive device. A blasting cap may be connected to the detonation cord at the point that is exterior to the explosive device.

In some exemplary embodiments, the explosive material may fill the entire volume of the hollow tube between the pair of spaced-apart flanges. In other embodiments, the device may include one or more hollow spacers disposed in the hollow tube between the pair of spaced-apart flanges, and the explosive material may fill the remaining volume between the pair of spaced-apart flanges. One of the hollow spacers may extend the entire length between the pairs of spaced-apart flanges, and the explosive material may form an annular cylinder around the hollow spacer.

In some embodiments, the device may include a shock impedance barrier in the form of an annular cylinder disposed between the spaced-apart flanges, and the explosive material may be disposed in a center opening of the annular cylinder.

In some embodiments, one of the first and second sleeves may include a V-shaped groove formed in the end distal the hollow cylindrical tube. The V-shaped groove may be configured to mate with a V-shaped projection formed on the bottom interior surface of a COTS one gallon jug. The other of the first and second sleeves may include a threaded central opening formed in an end distal the hollow cylindrical tube. The threaded central opening may be configured to receive an externally threaded portion of a cable gland. The hollow tube may be vertically disposed in the COTS one gallon jug, and the V-shaped projection of the jug may be disposed in the V-shaped groove of the one of the first and second sleeves. A cap may be fixed to a top opening of the jug with the cable gland extending through the cap and into the threaded central opening of the other of the first and second sleeves. A length of detonation cord may extend from inside one of the pair of spaced-apart flanges, through the central opening of the flange, through the other of the first and second sleeves and through the cable gland to a point that is exterior to the explosive device. The jug may be filled with fluid which surrounds the hollow tube. The hollow tube may extend into a neck portion of the jug. A blasting cap may be connected to the detonation cord at the point exterior to the explosive device.

In a second aspect, each of the mating pair of semi-cylindrical halves includes a male semi-cylindrical portion and a female semi-cylindrical portion. The male semi-cylindrical portion may include a reduced diameter section at one end thereof that is inserted in the female semi-cylindrical portion and the female semi-cylindrical portion may include a flange formed on an interior surface thereof against which the reduced diameter section of the male portion abuts. Each of the first and second sleeves may include a central opening therein. The device may include a COTS five gallon jug wherein the hollow tube is vertically disposed in the jug and a projection on an interior bottom surface of the jug is disposed in the central opening in one of the first and second sleeves. A plug may be inserted in a top opening of the jug, and the plug may include a cable gland extending through the plug. A length of detonation cord may extend from inside one of the pair of spaced-apart flanges, through the central opening of the flange, through another of the first and second sleeves and through the cable gland to a point that is exterior to the explosive device. The jug may be filled with fluid that surrounds the hollow tube. The hollow tube may extend into a neck portion of the jug such that a bottom surface of the plug exerts a compressive force on a top surface of the tube. A cap may close the top portion of the jug. A blasting cap may be connected to the detonation cord at the point exterior to the explosive device.

In a third aspect, a method may include providing the device of the first aspect and placing the explosive material in the separated semi-cylindrical halves. The method may include providing a length of detonation cord, forming a knot in one end of the detonation cord and placing the knot on an interior side of one of the pair of spaced-apart flanges. The detonation cord may be threaded through the central opening in the one of the spaced-apart flanges and through one of the first and second sleeves to a point that is exterior to the explosive device. Then, the mating pair of semi-cylindrical halves may be joined together and the first and second sleeves placed over the lesser diameter opposing ends of the tube.

In some embodiments, the method may include placing the device in a hole in the ground, attaching a blasting cap to a second end of the detonation cord and activating the device by initiating the blasting cap.

In other embodiments, the method may include filling a one gallon COTS jug with water, placing the device vertically in the jug so that the hollow tube is disposed in the neck portion of the jug, and feeding the detonation cord through a cable gland disposed in a jug cap and closing the jug with the jug cap. The device may be placed near a target, a blasting cap attached to the second end of the detonation cord and the device activated by initiating the blasting cap. The blasting cap may be located outside of the jug.

In some embodiments, the method may include placing the device underwater near an underwater target. A blasting cap may be attached to a second end of the detonation cord wherein the second end is located near a surface of the water. The device may be activated by initiating the blasting cap.

Other embodiments of the third aspect may include the step of filling a five gallon COTS jug with water, placing the device vertically in the jug so that the hollow tube is disposed in the neck portion of the jug, feeding the detonation cord through a cable gland disposed in a plug in the neck portion of the jug and closing the jug with a jug cap. The device may be placed near a target, a blasting cap attached to a second end of the detonation cord and the device activated by initiating the blasting cap. The blasting cap may be located outside of the jug.

In a fourth aspect, an explosive device may include a hollow member formed of a mating pair of halves. The member may have opposing ends and a pair of spaced-apart flanges formed on an interior surface thereof. Each flange may include a central opening therein. The member may include first and second sleeves disposed over the opposing ends of the member to thereby hold the mating halves together. Explosive material may be disposed in the hollow member.

In some embodiments, the hollow member has an hourglass shape and the hollow member may be disposed in a fluid-filled container.

The fluid-filled container may have, for example, a cylindrical shape or an hourglass shape.

In some embodiments, the hollow member has a cylindrical shape and the hollow member is disposed in a fluid-filled container having an hourglass shape.

The invention will be better understood, and further aspects, objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

Additive manufacturing techniques may enable EOD personnel to produce novel gear and tools without the logistical burden associated with procurement from outside vendors. Novel EOD tools may be produced using relatively simple and inexpensive manufacturing machines, such as 3D printers. The 3D printed parts may be combined with COTS parts to produce needed EOD tools.

Aspects of the invention include explosive devices formed from hollow members of various shapes and sized filled with explosive materials. The hollow members may be made of mating halves that are packed or loaded with explosive material prior to the mating halves being joined together. In some aspects, the hollow members are placed in fluid-filled containers such that the explosive reaction creates a wave of fluid that impacts a target. The hollow members may have various shapes. By way of example only, the shapes may include cylindrical shapes and hourglass shapes. The fluid-filled containers may be COTS containers such as bottles or jugs of various sizes and shapes. For example, the fluid-filled containers may include one gallon containers used to market milk or water, or five gallon containers used to market water, or other containers. The fluid in the containers may be water, for example. Other shapes of fluid-filled containers may be used, for example, hourglass shaped containers.

The hollow members may include a pair of opposing flanges formed on interior surfaces thereof to define a volume for packing explosive. One or both flanges may have an opening therein for receiving detonation cord that is used to initiate the explosive packed in the hollow member. A knot of detonation cord may be formed inside the flange to anchor the cord in or adjacent to the packed explosive. The hollow members may include sleeves disposed over the opposing ends of the member to thereby hold the mating halves together. The sleeves may be fixed to the hollow member, for example, by threads or a friction fit.

The ends or sleeves of the hollow members may have features for interfacing with features of the fluid-filled containers in which they are placed. Various types of spacers may be placed in the volume between the pair of opposing flanges to customize the amount or geometry of the explosive that is packed in the hollow members.

Figures 1A, 1B, 1C, 1D, 1E:
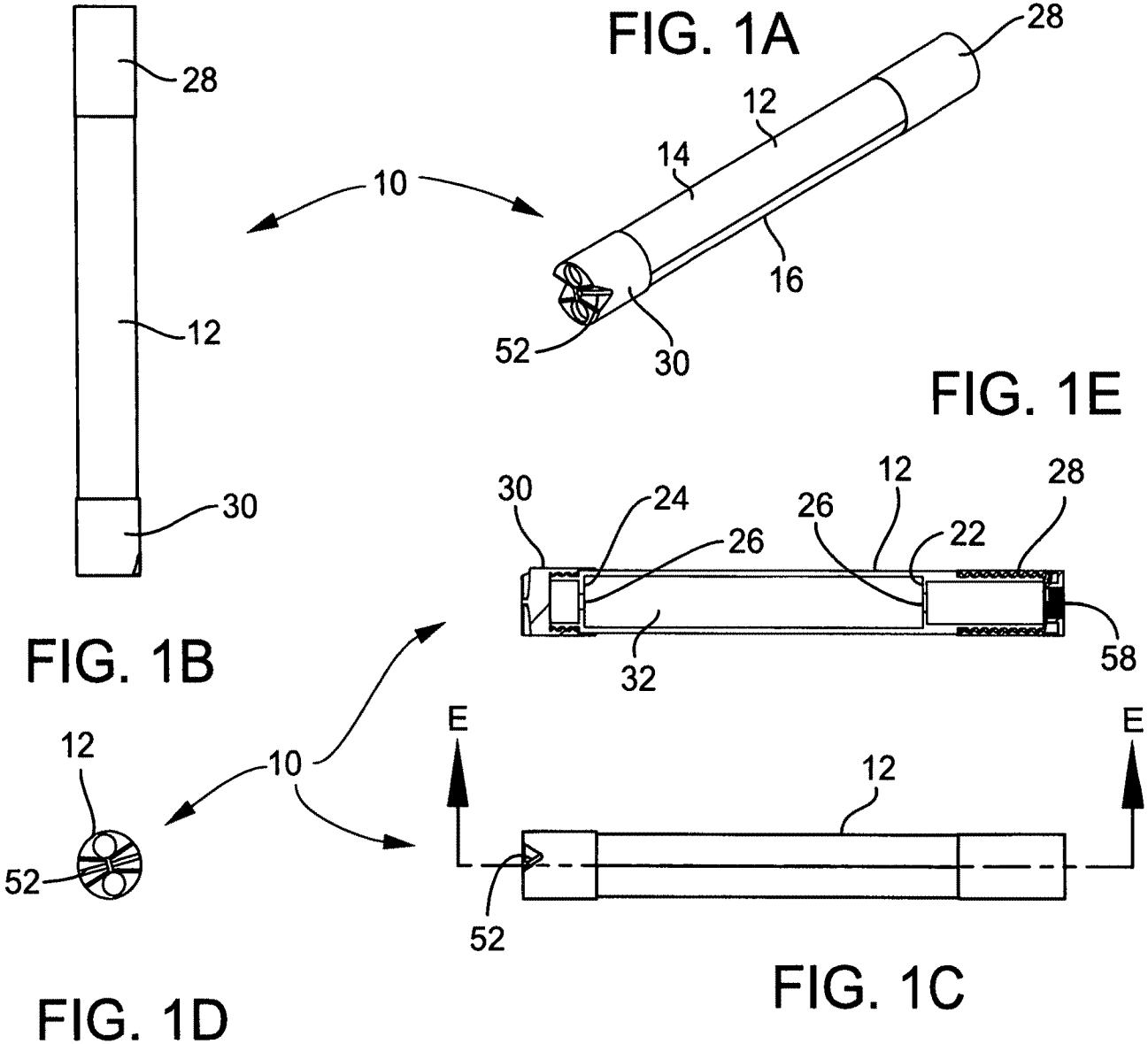
FIG. 1A is a perspective view of an explosive device.
FIG. 1B is a side view of FIG. 1A.
FIG. 1C is a front view of FIG. 1A.
FIG. 1D is an end view of FIG. 1C.
FIG. 1E is a sectional view taken along the line E-E of FIG. 1C.
Figure 1F:
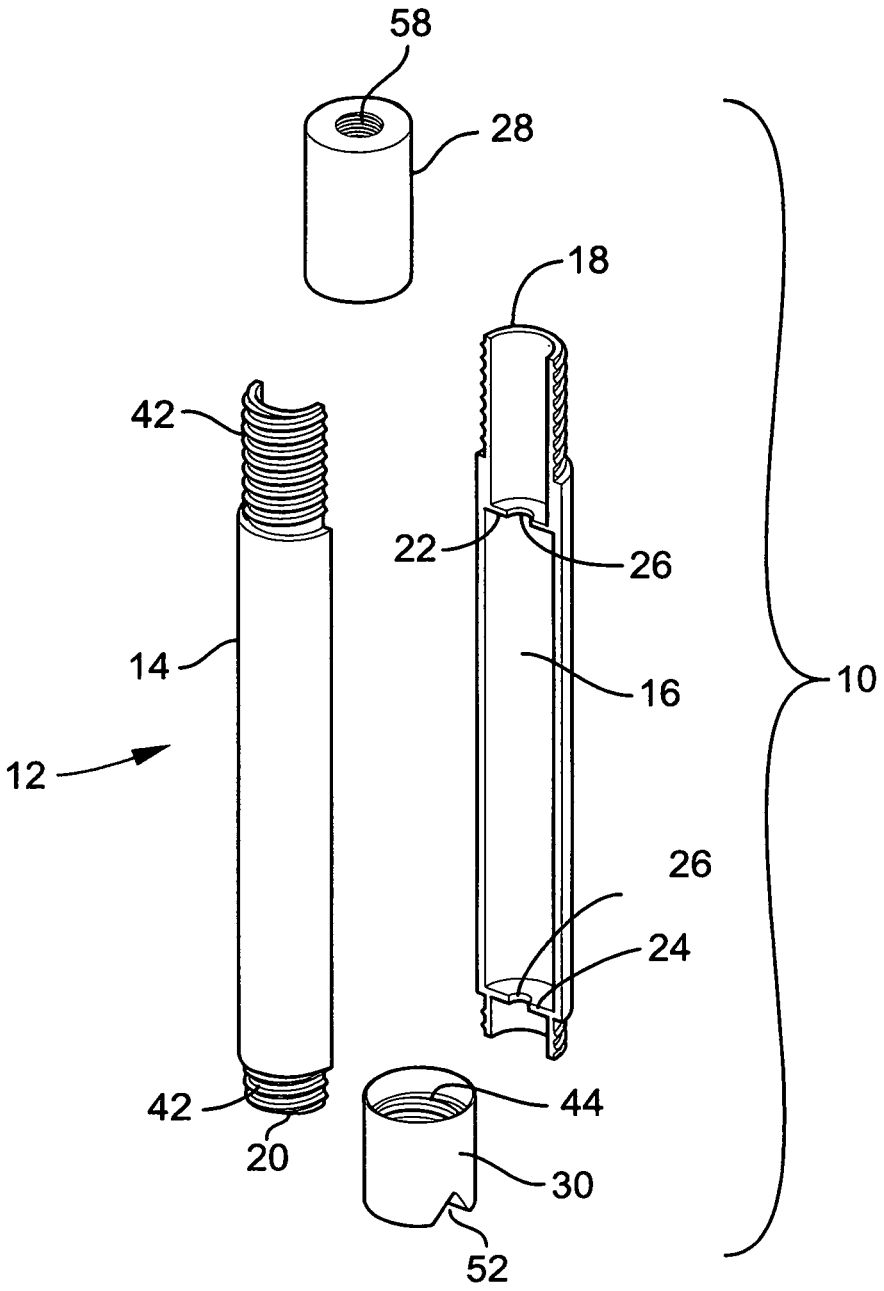
FIG. 1F is an exploded view of the device of FIG. 1A.
Figure 1G:
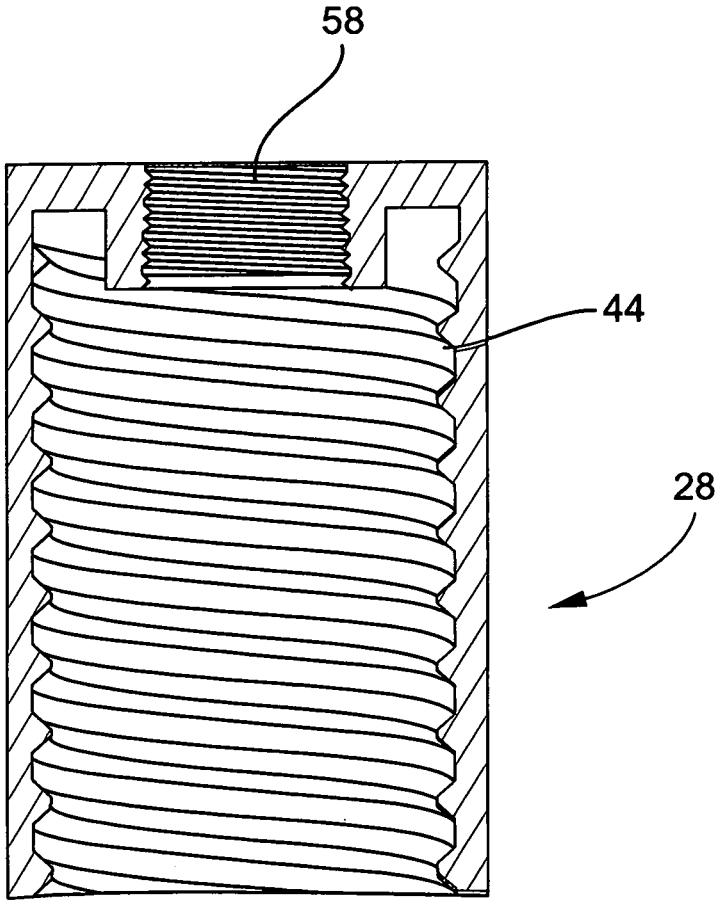
FIG. 1G is a sectional view of a sleeve of FIG. 1A taken along a bisecting plane.

Referring to FIGS. 1A-G, FIG. 1A is a perspective view of an explosive device 10. FIG. 1F is an exploded view of FIG. 1A. Device 10 includes a hollow cylindrical tube 12 formed of a mating pair of semi-cylindrical halves 14, 16. As shown in FIG. 1F, tube 12 has opposing ends 18, 20 (FIG. 1F) of lesser outside diameter than an outside diameter of the remainder of the tube 12. Tube 12 includes a pair of spaced-apart flanges 22, 24 formed on an interior surface thereof. Each flange 22, 24 includes a central opening 26. Tube 12 includes first and second sleeves 28, 30 disposed over the lesser diameter opposing ends 18, 20 of the tube to thereby hold the semi-cylindrical halves 14, 16 together. An explosive material 32 (FIG. 1E) is disposed in the hollow cylindrical tube 12. The explosive material 32 may be, for example, one or more of C-4, detonation cord and flexible rubberized explosive.

In some embodiments, the opposing ends 18, 20 of tube 12 may have external threads 42 that engage internal threads 44 of respective ones of the first and second sleeves 28, 30. In other embodiments, the first and second sleeves 28, 30 may form a friction fit with the opposing ends 18, 20 without using threads.

Figure 1H:
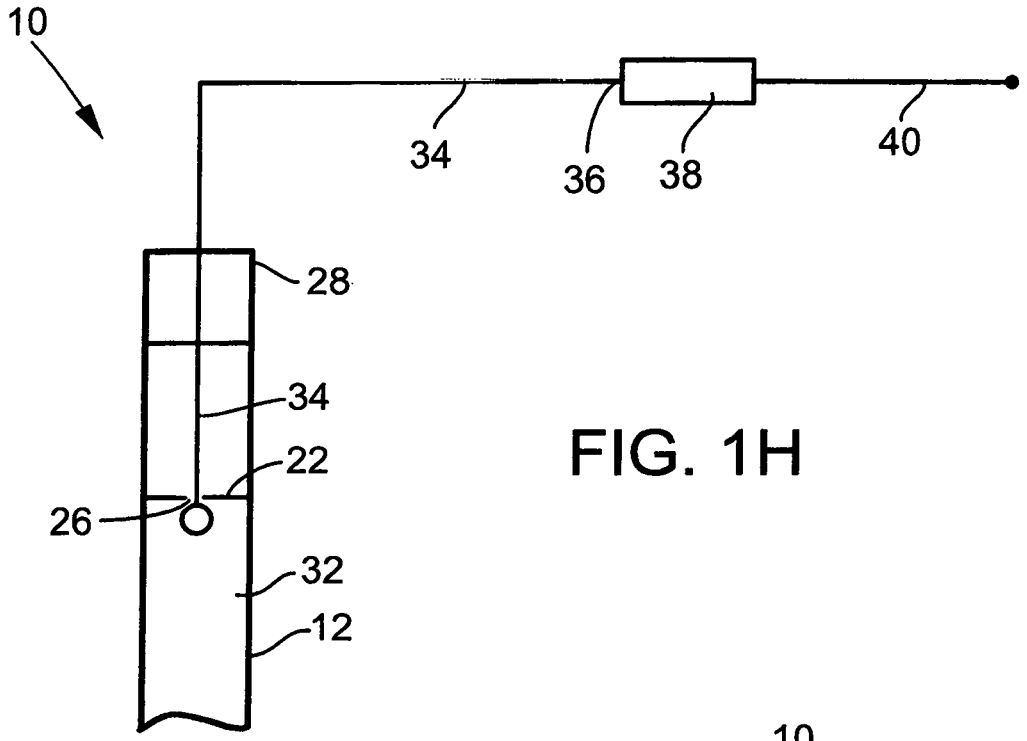
FIG. 1H is a schematic view of an explosive device.

Referring to FIG. 1H, a length of detonation cord 34 may extend from inside one of the pair of spaced-apart flanges 22, through the central opening 26 and through one of the first and second sleeves 28 to a point 36 that is exterior to the explosive device 10. A blasting cap 38 may be connected to the detonation cord 34 at the point 36. A device 40 for initiating the blasting cap 38 is attached to the blasting cap. The initiator 40 may be, for example, an electrical detonator or a shock tube.

In some embodiments, the explosive material 32 may fill the entire volume in the hollow tube between the pair of spaced-apart flanges 22, 24. In other embodiments, one or more hollow spacers 46 (FIG. 1I) may be disposed in the tube 12 and fill a portion of the volume between the pair of spaced-apart flanges 22, 24. The explosive material 32 may fill the remaining volume between the pair of spaced-apart flanges. The hollow spacers 46 may have an outside diameter such that the spacer 46 fits against the inner surface of tube 12. Spacers 46 may be made of a variety of materials, for example, plastics and other materials.

Figure 1J:
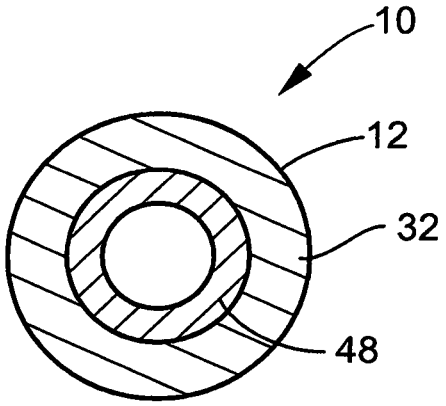
FIG. 1J is a transverse cross-sectional view of an explosive device.

In some embodiments, as shown in the cross-sectional view of FIG. 1J, a hollow tube or spacer 48 may extend the entire length between the pairs of spaced-apart flanges 22, 24 so that explosive material 32 forms an annular cylinder around the hollow spacer 48. Spacer 48 may be made of a variety of materials, for example, plastics and other materials. Compared to a tube 12 completely packed with explosive 32, the use of spacer 48 results in a reduction in the net amount of explosive 32, but the outside geometry of the tube 12 remains the same compared to a solid core of explosive. When tube 12 is disposed in a fluid-filled container, this amounts to being able to use the same amount of fluid in the container with less explosive, compared with a solid core of using less explosive with more fluid (for a solid core, the outside diameter of the explosive tube 12 shrinks which increases the amount of fluid in the container).

Figure 1K:
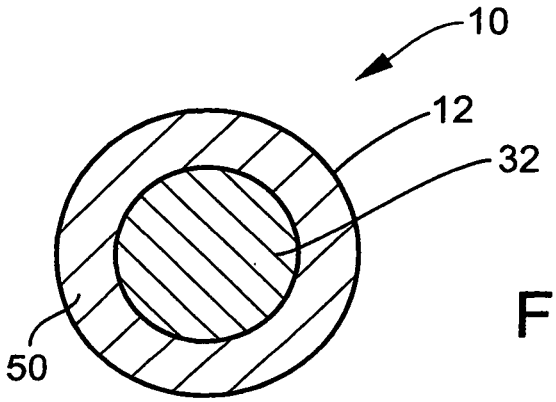
FIG. 1K is a transverse cross-sectional view of an explosive device.
Figure 1I:
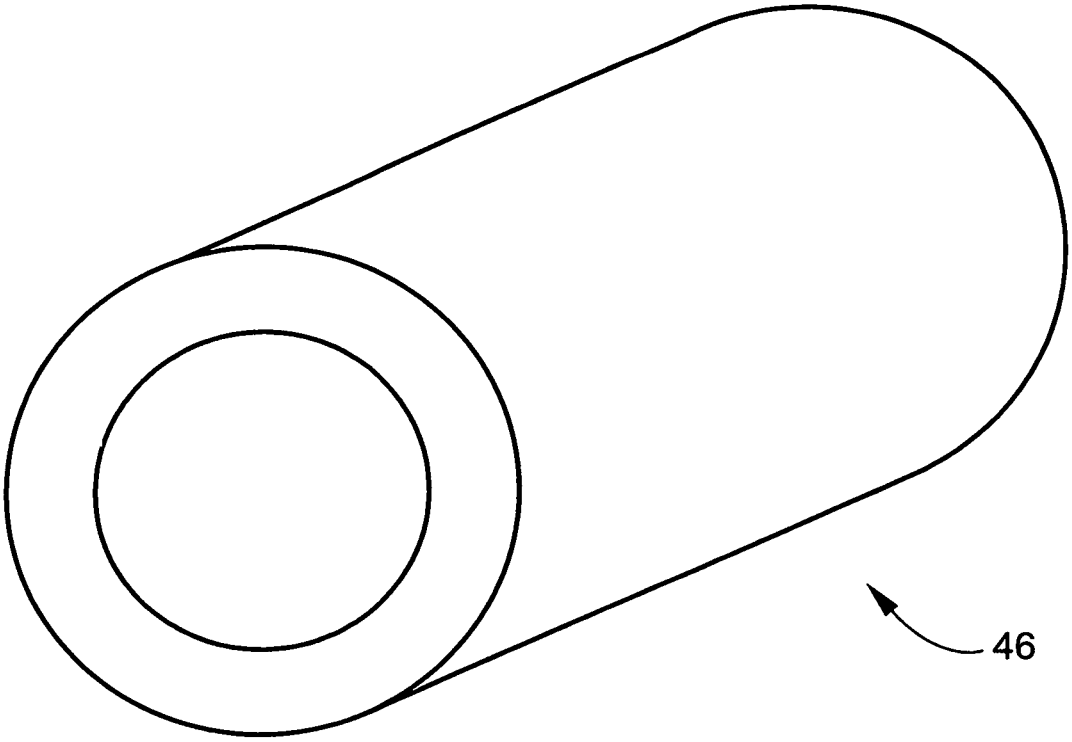
FIG. 1I is a perspective view of a hollow spacer.

As shown in FIG. 1K, in some embodiments, device 10 may include a shock impedance barrier 50 in the form of an annular cylinder disposed between the spaced-apart flanges 22, 24. Barrier 50 may be made of, for example, clay or foam. The annular shock impedance barrier 50 may have an outside diameter that extends to an inside diameter of the hollow tube 12. Explosive material 32 is disposed in the center opening of the shock impedance barrier annular cylinder 50. When tube 12 is disposed in a fluid-filled container, shock impedance barrier 50 may help to reduce the initial shock to move the fluid radially outward and keep the fluid wave together. If separation of the fluid is delayed (large fluid wall thickness), the target may incur more damage without the use of a higher shock load. The shock impedance barrier may also be used external to tube 12.

In some embodiments, sleeve 30 may include a V-shaped groove 52 (FIG. 1A) formed in an end distal the tube 12. The V-shaped groove 52 is configured to mate with a V-shaped projection 54 (FIG. 2A) formed on a bottom interior surface of a plastic COTS jug, such as a COTS one gallon jug 56.

Sleeve 28 may include a threaded central opening 58 (FIGS. 1A and 1G) formed in an end distal tube 12. The threaded central opening 58 is configured to receive the bottom externally threaded portion of a cable gland 60 (FIG. 2B), such as a PG-9 cable gland.

Figure 2A:
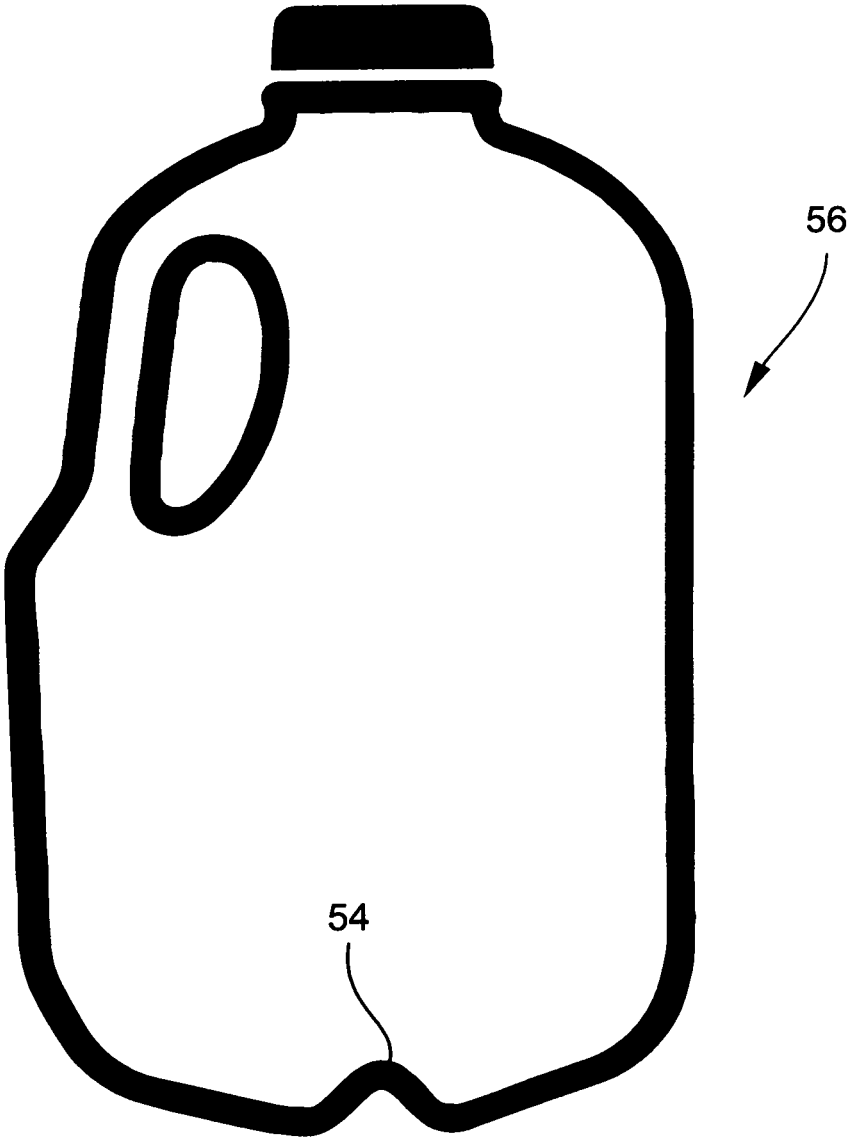
FIG. 2A CONVENTIONAL ART
FIG. 2A is a side view of a COTS one gallon jug.
Figure 2B:
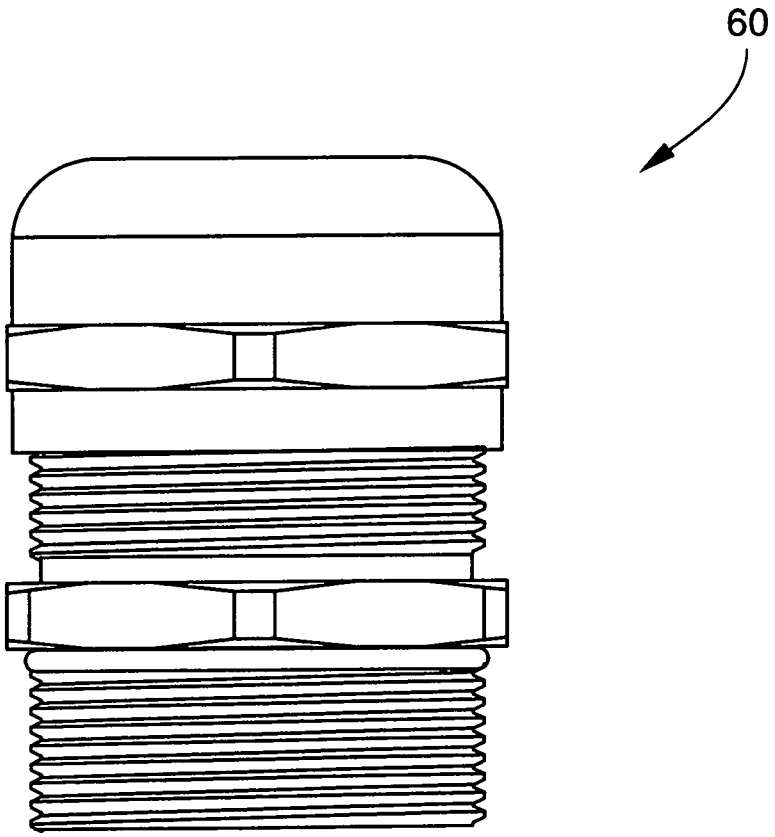
FIG. 2B CONVENTIONAL ART
FIG. 2B is a side view of a cable gland.
Figure 2C:
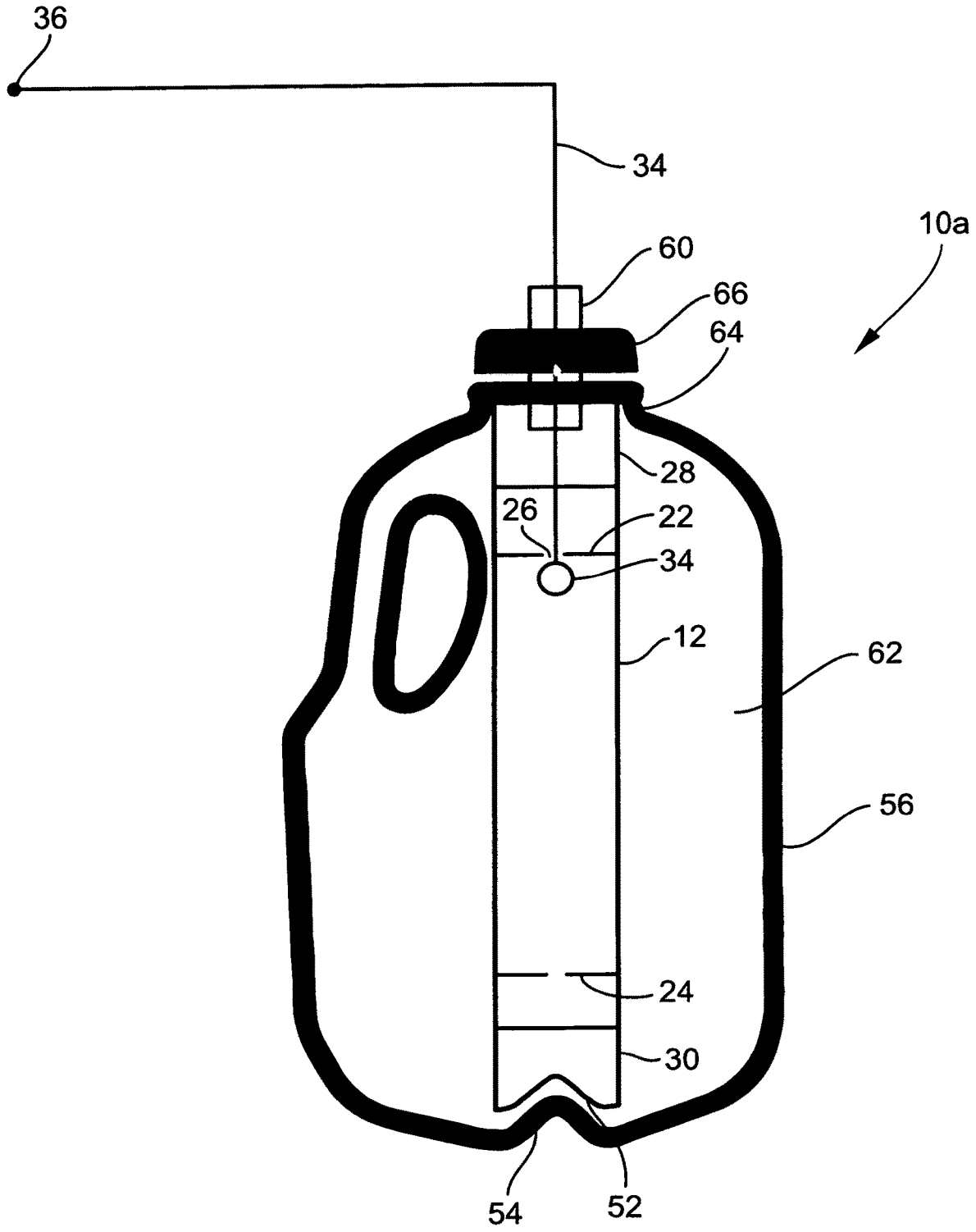
FIG. 2C is a schematic of an explosive device.
Figures 3A, 3B, 3C, 3D, 3E:
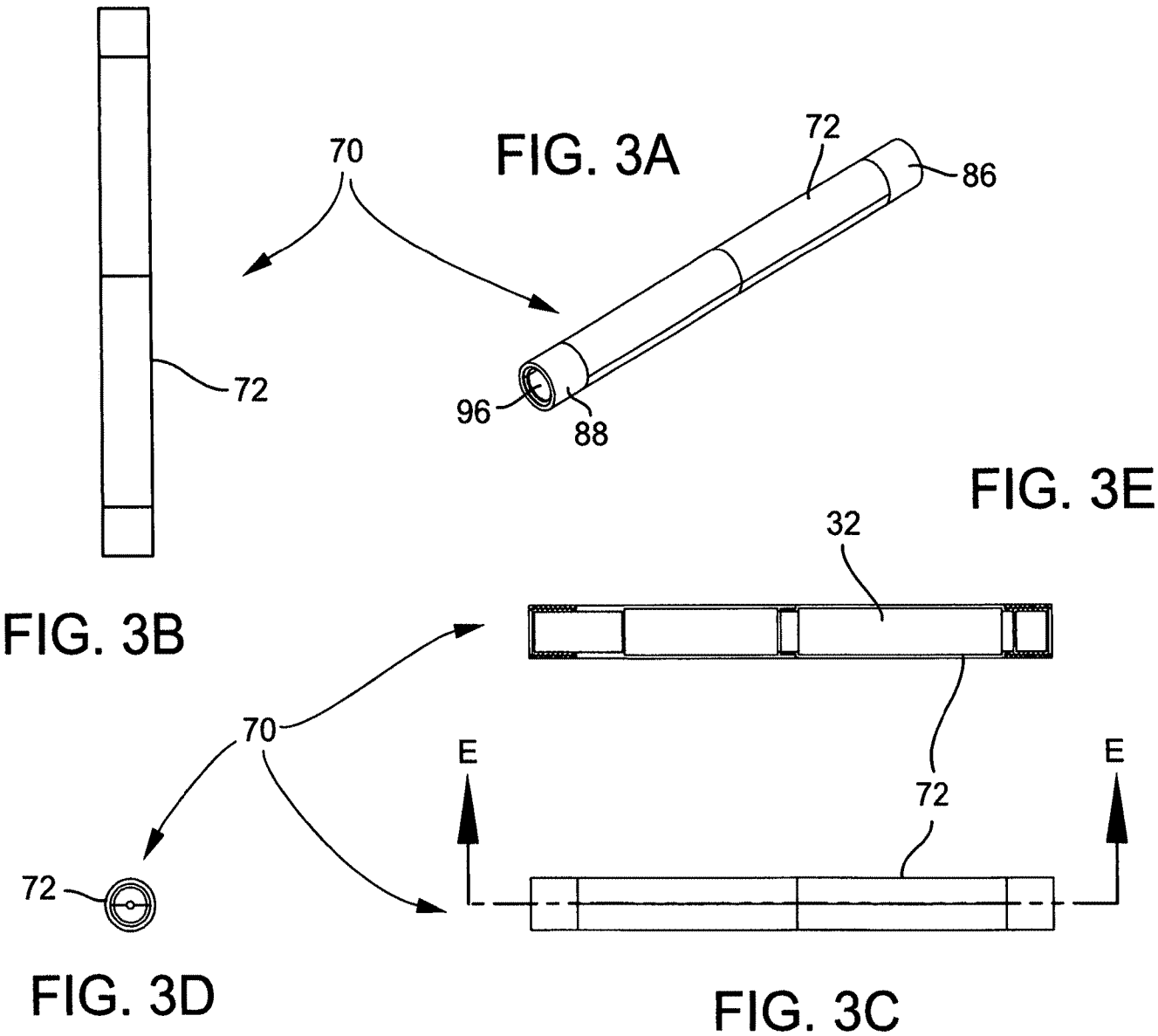
FIG. 3A is a perspective view of an explosive device.
FIG. 3B is a side view of FIG. 3A.
FIG. 3C is a front view of FIG. 3A.
FIG. 3D is an end view of FIG. 3C.
FIG. 3E is a sectional view taken along the line E-E of FIG. 3C.
Figure 3F:
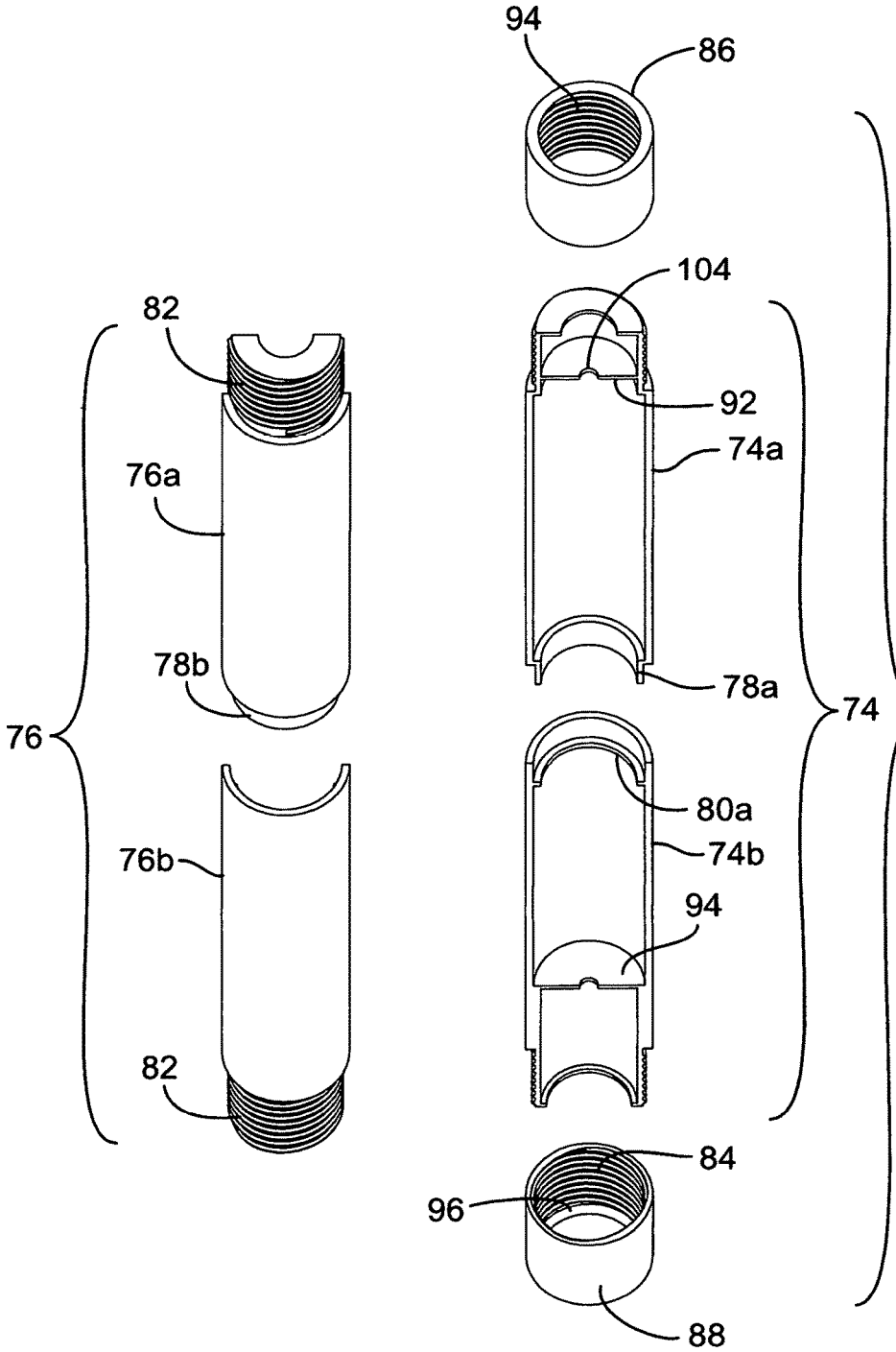
FIG. 3F is an exploded view of the device of FIG. 3A.

An explosive device 10*a* (FIG. 2C) may include a COTS jug 56 (FIG. 2A). Jugs 56 are generally sold filled with water or milk and are thus readily available to EOD personnel for construction of EOD equipment. As shown schematically in FIG. 2C, tube 12 may be vertically disposed in jug 56 such that the V-shaped projection 54 of the jug is disposed in the V-shaped groove 52 of the sleeve 30 of the tube. Jug 56 is filled with a fluid 62, for example, water. Preferably, the tube 12 extends into a neck portion 64 of the jug. The cap 66 of the jug may be a thread-on type, a plug type, or a snap-on type. The cap 66 is fixed to the top opening of the jug. An opening is formed in cap 66 and an externally threaded lower portion of cable gland 60 extends through the cap opening and engages the internally threaded opening 58 in sleeve 28. The detonation cord 34 extends from inside the flange 22, through the central opening 26 of the flange 22, through the sleeve 28 and through the cable gland 60 to the point 36 (see also FIG. 1H) that is exterior to the explosive device 10*a*.

It may be desirable to use containers larger than a one gallon jug. For larger containers, the length of tube 12 may be increased. For longer tubes 12, it may be helpful to alter the construction of the tube. For example, FIGS. 3A-F show an explosive device 70 including a hollow tube 72. Referring to the exploded view of FIG. 3F, each one of the mating pair of semi-cylindrical halves 74, 76 includes a male semi-cylindrical portion 74*a*, 76*a* and a female semi-cylindrical portion 74*b*, 76*b*. Each male portion 74*a*, 74*b* has a reduced diameter section 78*a*, 78*b* at one end thereof that is inserted in the respective female portion and each female portion includes a flange 80*a* (the flange for female portion 76*b* that corresponds to flange 80*a* is not visible in FIG. 3F) formed on an interior surface thereof against which the respective reduced diameter sections 78*a*, 78*b* of the male portions abut.

The opposing ends of semi-cylindrical halves 74, 46 may have external threads 82 that engage internal threads 84 of respective ones of the first and second sleeves 86, 88. In lieu of a threaded connection, the first and second sleeves 86, 88 may form a friction fit with the opposing ends of halves 74, 46. Each of the first and second sleeves 86, 88 may include a central opening 94, 96 therein.

In some embodiments, explosive material 32 (FIG. 3E) may fill the entire volume of tube 72 between the pair of spaced-apart flanges 92, 94 in the interior of tube 72.

In some embodiments, the explosive device 70 may include one or more hollow spacers 46 (FIG. 1I) disposed in tube 72. Spacer 46 may fill a portion of the volume between the pair of spaced-apart flanges 92, 94. The explosive material 32 may fill the remaining volume between the pair of spaced-apart flanges. The hollow spacers 46 may have an outside diameter such that the spacer 46 fits against the inner surface of tube 72.

In some embodiments and similar to the device 10 shown in the sectional view of FIG. 1J, a hollow tube or spacer 48 may extend the entire length between the pairs of spaced-apart flanges 92, 94 so that explosive material 32 forms an annular cylinder around the hollow spacer 48. In some embodiments and similar to the device 10 shown in FIG. 1K, device 70 may include a shock impedance barrier 50 in the form of an annular cylinder disposed between the spaced-apart flanges 92, 94. Barrier 50 may be made of, for example, clay or foam. The annular cylindrical shock impedance barrier 50 may have an outside diameter that extends to an inside diameter of the hollow tube 72. Explosive material 32 is disposed in the center opening of the shock impedance barrier annular cylinder 50.

Figure 4A:
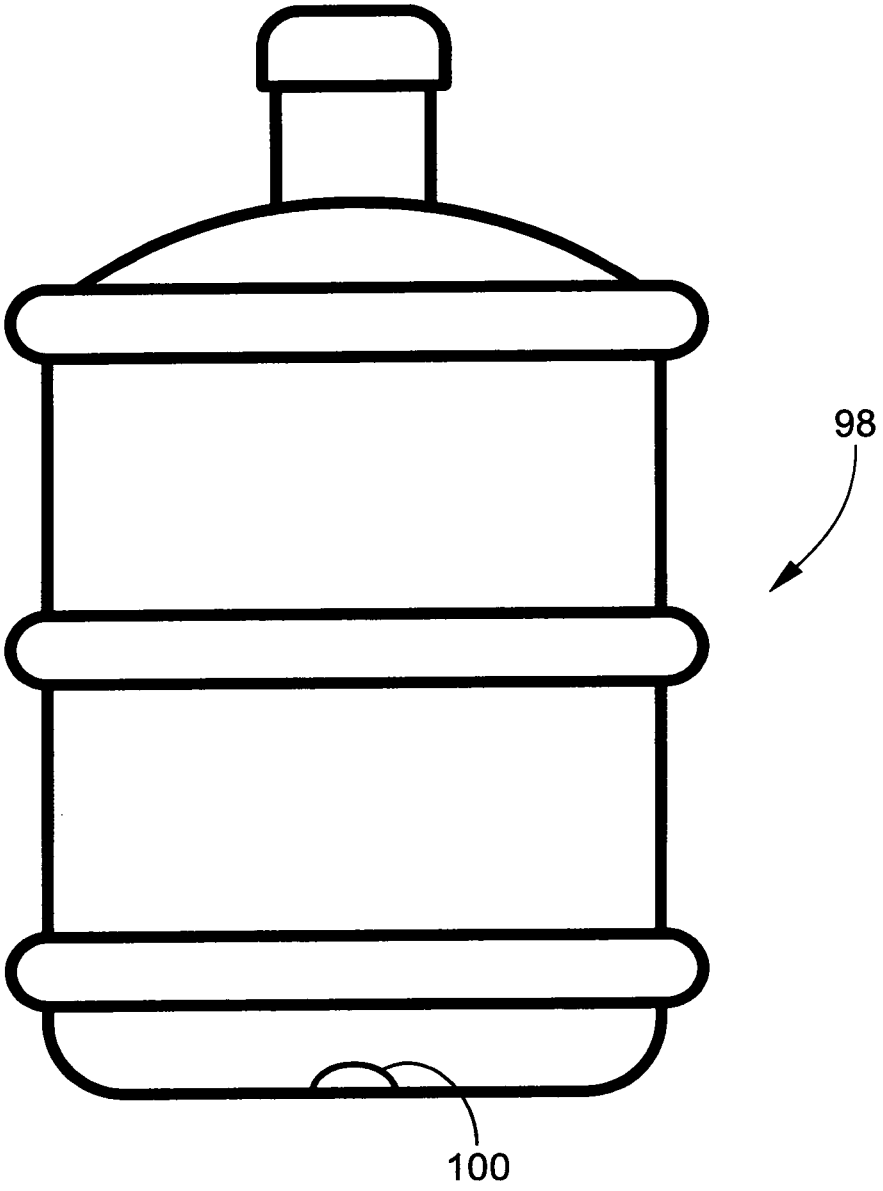
FIG. 4A CONVENTIONAL ART
FIG. 4A is a schematic of a COTS five gallon water jug.
Figure 4B:
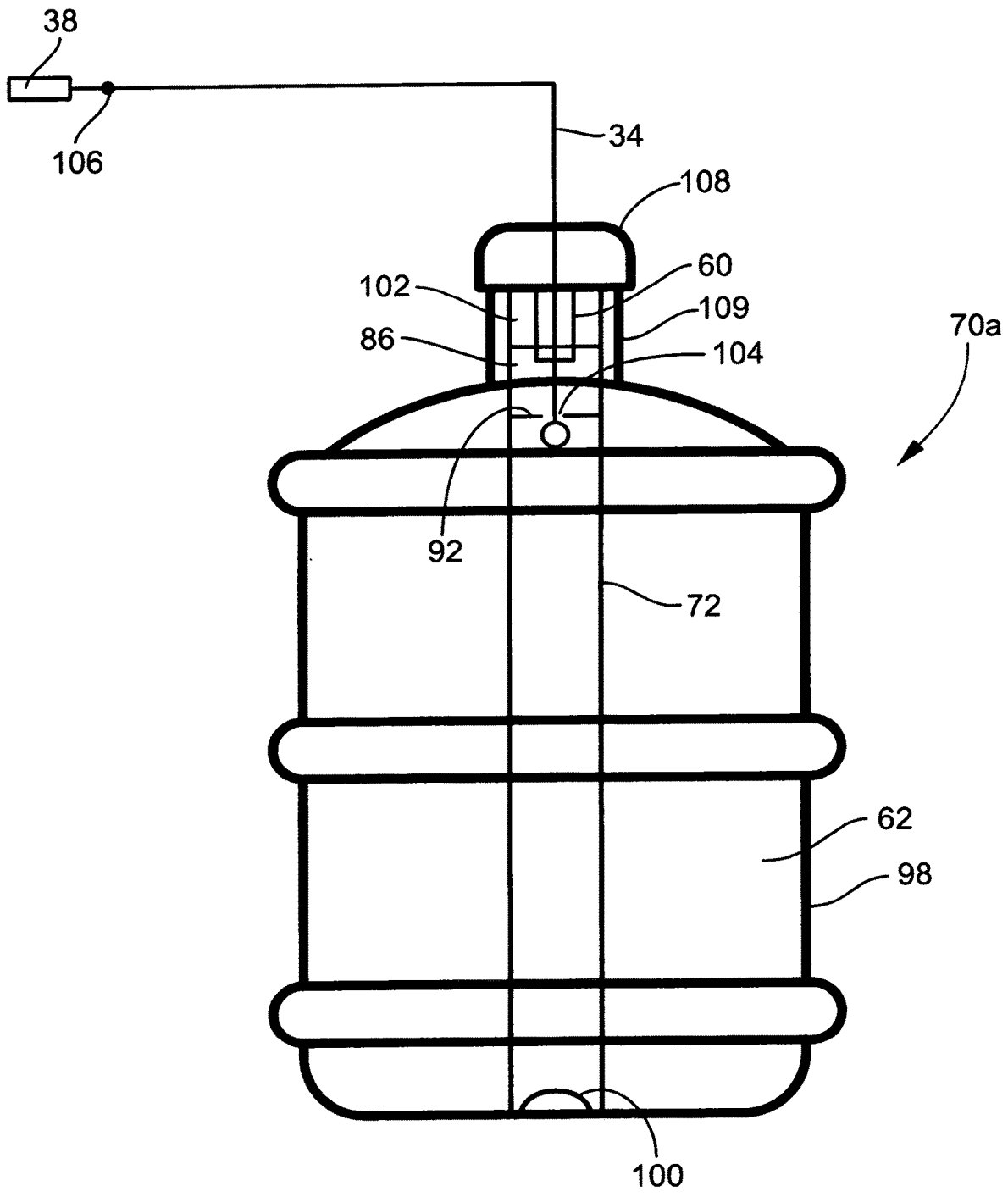
FIG. 4B is a schematic view of an explosive device.

FIG. 4A is a schematic of a COTS five gallon water jug 98 having a projection 100 on a bottom interior surface. Referring to FIG. 4B, explosive device 70*a* may include jug 98 wherein the tube 72 is vertically disposed in the jug 98 and projection 100 on the interior bottom surface of the jug is disposed in the central opening 96 (FIGS. 3A and 3F) in sleeve 88. A plug 102 may be inserted in a top opening of the jug 98. Plug 102 may be made of, for example, plastic. A cable gland 60 (FIG. 2B) may extend through the plug 102. A length of detonation cord 34 may extend from inside the flange 92 (see FIG. 3F also), through the central opening 104 of the flange 92, through sleeve 86 and cable gland 60 to a point 106 that exterior to the explosive device 70*a*. A fluid 62, such as water, may be disposed in the jug 98 and surround the tube 72.

The tube 72 may extend into a neck portion 109 of the jug 98 such that a bottom surface of the plug 102 exerts a compressive force on a top surface of the tube 72. Device 70*a* may include a cap 108 that closes the top of the jug. Device 70*a* may further include a blasting cap 38 connected to the detonation cord 34 at the point 106 exterior to the jug 98 and an initiator for the blasting cap.

A novel method includes providing one of more of explosive devices 10 or 70 and placing explosive material 32 in the separated semi-cylindrical halves of device 10 or 70. Then, a knot is formed in an end of a length of detonation cord 34 and the knot is placed on the interior side of one of the pair of spaced-apart flanges in device 10 or 70. The cord 34 is placed through the central opening in the spaced-apart flange and through one of the first and second sleeves to a point that is exterior to the tube 12 or 72. The mating pair of semi-cylindrical halves is joined together and the first and second sleeves are fixed over the lesser diameter opposing ends of the tube 12 or 72. As noted above, the sleeves may be fixed by threads or a friction fit. The exterior of tube 12 or 72 may be wrapped with tape to provide additional structural strength. The cord 34 is also extended exterior to any fluid-filled container in which tube 12 or 72 may be disposed.

Figure 4C:
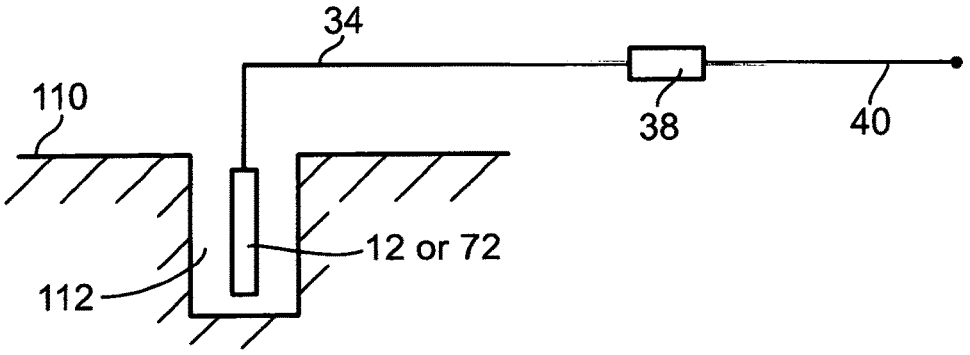
FIG. 4C is a schematic view of an explosive device in the ground.

As shown schematically in FIG. 4C, the method may include placing the device 12 or 72 in a hole 112 in the ground 110. A blasting cap 38 may be attached to the detonation cord 34. Blasting cap 34 may be initiated by an electrical initiator/shock tube 40, for example. Device 12 or 72 is activated by initiating the blasting cap 34.

Figure 4D:
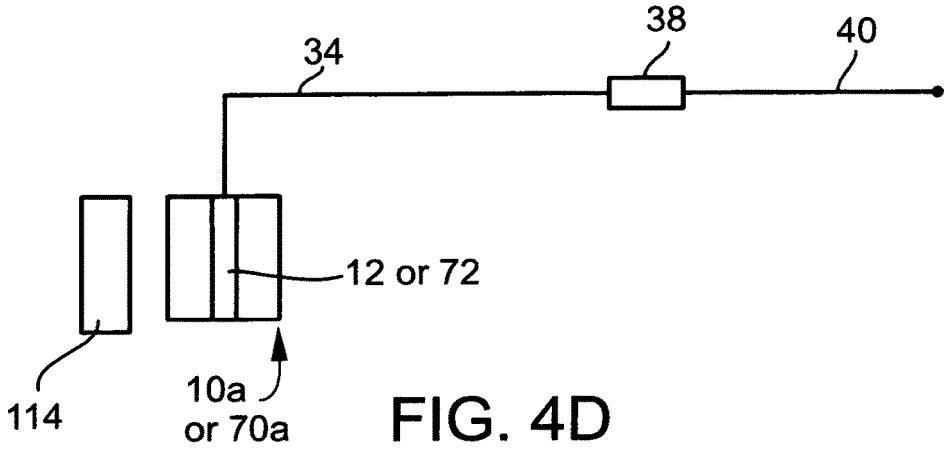
FIG. 4D is a schematic view of an explosive device placed near a target.

In some embodiments, a novel method may include filling a one gallon COTS jug with water, placing the tube 12 vertically in the jug so that the tube is disposed in the neck portion of the jug, feeding the detonation cord 34 through a cable gland disposed in the jug cap and closing the jug with the jug cap. Then, the device 10*a* may be placed near a target 114 (FIG. 4D), a blasting cap 38 attached to an end of the detonation cord 34 and the device 10 activated by initiating the blasting cap 38 using, for example, an electrical initiator or shock tube 40.

In some embodiments, the method may include filling a five gallon COTS jug with water, placing the tube 72 vertically in the jug so that the tube 72 is disposed in the neck portion of the jug, feeding the detonation cord 34 through a cable gland disposed in a plug in the neck portion of the jug and closing the jug with a jug cap. Then, the device 70*a* may be placed near a target 114 (FIG. 4D), a blasting cap 38 attached to an end of the detonation cord 34 and the device activated by initiating the blasting cap 38 using, for example, an electrical initiator or shock tube 40.

Figure 4E:
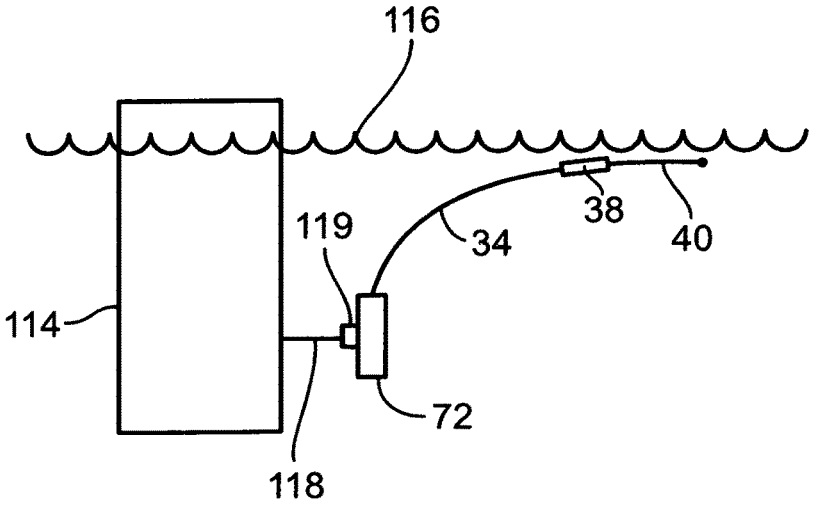
FIG. 4E is a schematic view of an explosive device placed near an underwater target.
Figure 4F:
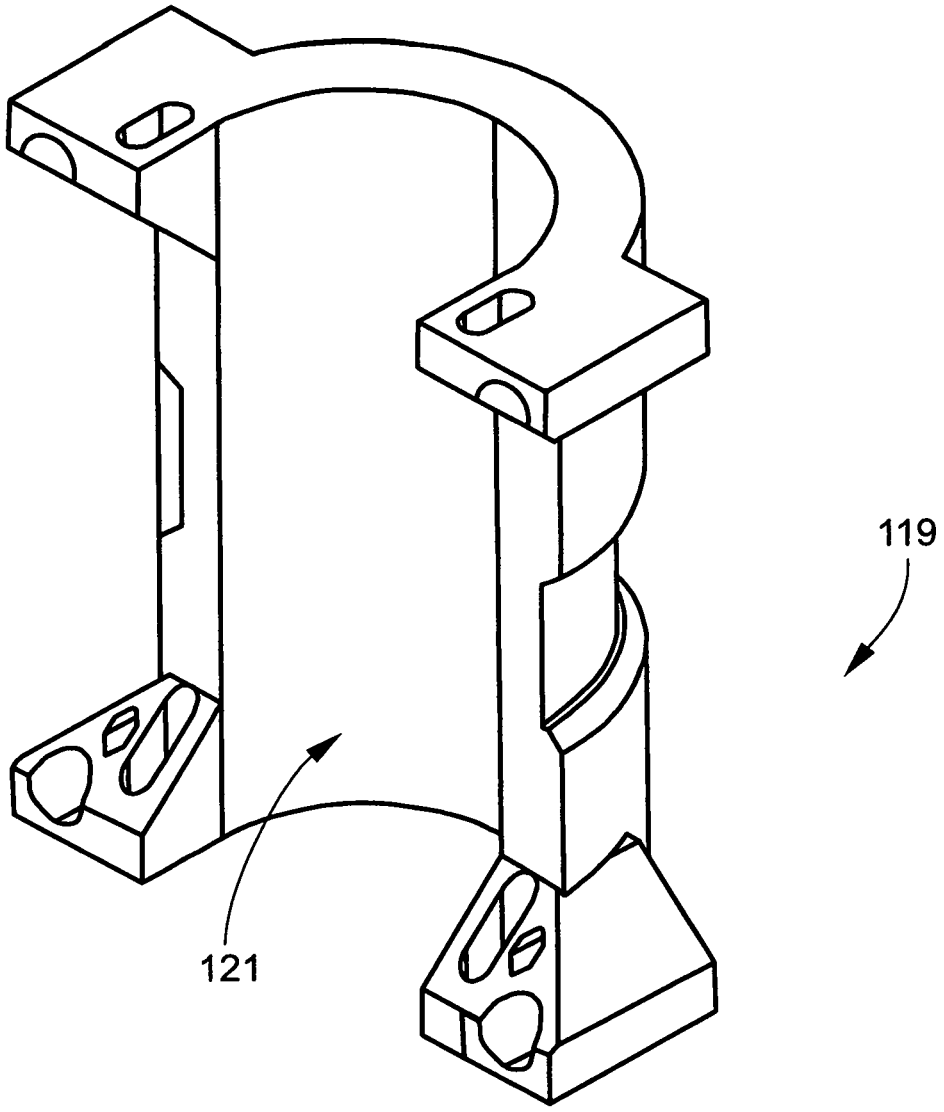
FIG. 4F is a perspective view of a stand for holding a cylindrical shaped explosive device.

As shown schematically in FIG. 4E, in some embodiments, the method may include placing the tube 72 under the surface 116 of the water near an underwater target 114. Device 72 may be modified so that the sleeves on both opposing ends include an opening with internal threads for receiving a cable gland 60 and detonation cord, similar to sleeve 28 shown in FIG. 1G. Device 72 may be fastened to a stand 119 (FIG. 4F) having an opening 121 for receiving the cylindrical surface of tube 72. Cable ties may be used to fasten device 72 to stand 119. Stand 119 is then fixed to a known EOD stand-off device 118 which is fixed to target 114. A blasting cap 38 may be attached to an end of the detonation cord 34. The end of the detonation cord 34 may be located near a surface 116 of the water. Then, the device 72 is activated by initiating the blasting cap using, for example, an electrical initiator or shock tube 40.

Figure 5A:
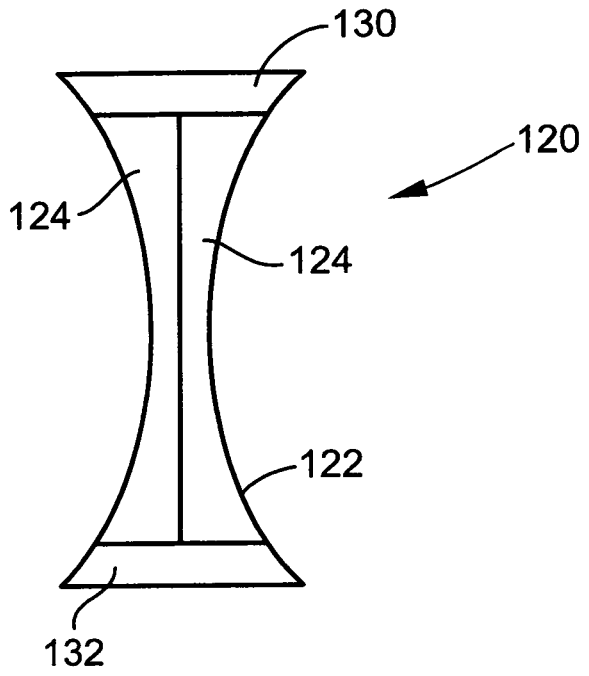
FIG. 5A is a schematic view of an explosive device.
Figure 5B:
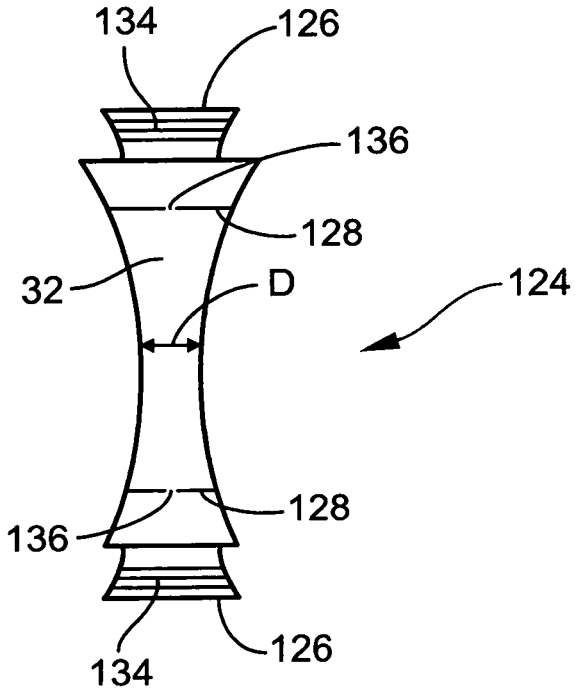
FIG. 5B is a schematic view of a mating half of an explosive device.

As shown schematically in FIG. 5A, in some embodiments, an explosive device 120 may include a hollow member 122 with an hourglass shape. The member 122 may be made of a pair of mating halves 124 (FIG. 5B) with sleeves 130, 132 disposed on opposing ends of the mating halves 124. Each mating half 124 may include opposing ends 126. Opposing ends 126 may have external threads 134 for engaging internal threads of sleeves 130, 132. As an alternative to threads, sleeves 130, 132 may form a friction fit over smooth opposing ends of member 122. Each mating half 124 may include a pair of spaced-apart flanges 128. Explosive material 32 may be packed in the interior of member 122 between flanges 128. Flanges 128 may include a central opening 136 therein. Similar to the previously discussed explosive devices, a length of detonation cord 34 may extend from inside one of the pair of spaced-apart flanges 128, through a central opening 136 and through one of the sleeves 130, 132 to a point that is exterior to the explosive device 120. A blasting cap may be connected to the detonation cord at the point exterior to device 120. An advantage of an hour-glass shaped member 122 is that is provides more explosive per height compared to a cylindrical tube having a diameter equal to the narrow diameter D (FIG. 5B) of the hour-glass shaped member 122.

Figure 5C:
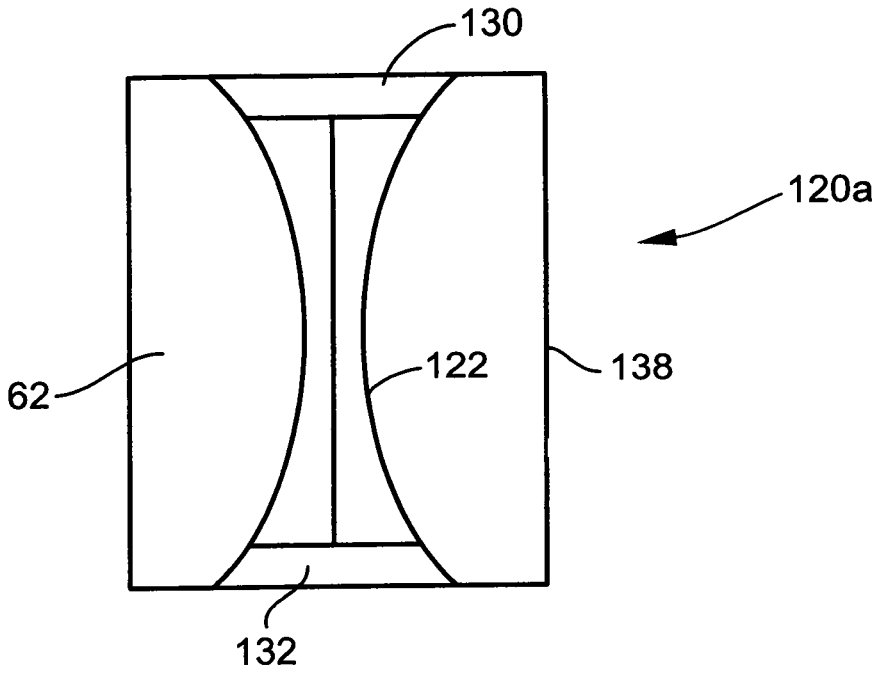
FIG. 5C is a schematic view of an explosive device.
Figure 5D:
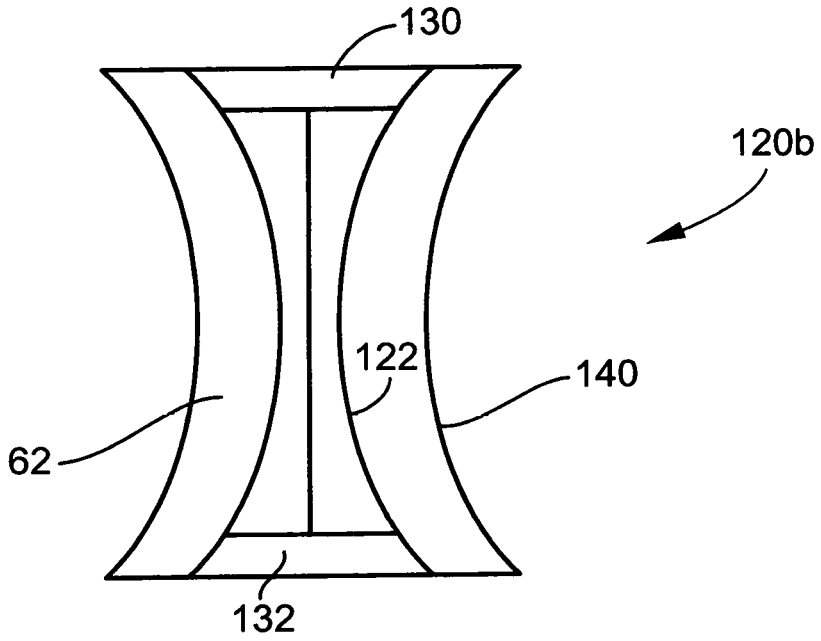
FIG. 5D is a schematic view of an explosive device.

Referring to FIGS. 5C and 5D, explosive devices 120*a* and 120*b* may include member 122 disposed in a fluid-filled container 138 or 140. The fluid-filled container 138, 140 may be filled with water 62. The fluid-filled container may be, for example, a generally cylindrical container 138 (FIG. 5C) or an hour glass shaped container 140 (FIG. 5D). An explosive-filled tube 12 or 72 may also be disposed in an hour-glass shaped, fluid-filled container 140.

Devices 120*a* and 120*b* may also include additional components discussed above with respect to explosive devices 10*a* and 70*a*, such as cable glands, remotely-located blasting caps, various shaped spacers and various shaped shock impedance barriers.

Any numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An explosive device, comprising:

a hollow cylindrical tube having a mating pair of semi-cylindrical halves, wherein the hollow cylindrical tube includes opposing ends of lesser outside diameter than an outside diameter of the remainder of the tube, wherein the hollow cylindrical tube includes a pair of spaced-apart flanges formed on an interior surface thereof, each flange including a central opening therein, and wherein the hollow cylindrical tube includes first and second sleeves disposed over the lesser diameter opposing ends of the tube to hold the semi-cylindrical halves together;

explosive material being disposed in the hollow cylindrical tube between the pair of spaced-apart flanges; and a length of detonation cord extending from inside one of the pair of spaced-apart flanges, through the central opening of the one of the pair of flanges and through one of the first and second sleeves to a point that is exterior to the explosive device.

2. The device of claim 1, wherein the explosive material is at least one of one of C-4, and flexible rubberized explosive.

3. The device of claim 1, further comprising a blasting cap being connected to the detonation cord at the point that is exterior to the explosive device.

4. The device of claim 1, wherein the opposing ends have external threads that engage internal threads of respective ones of the first and second sleeves.

5. The device of claim 1, wherein the first and second sleeves form a friction fit with the opposing ends.

6. The device of claim 1, wherein the explosive material fills an entire volume of the hollow tube between the pair of spaced-apart flanges.

7. The device of claim 1, further comprising at least one hollow spacer disposed in the hollow tube between the pair of spaced-apart flanges, wherein the explosive material fills a remaining volume between the pair of spaced-apart flanges.

8. The device of claim 7, wherein said at least one of the hollow spacer extends an entire length between the pairs of spaced-apart flanges and the explosive material forms an annular cylinder around the hollow spacer.

9. The device of claim 1, further comprising a shock impedance barrier in the form of an annular cylinder being disposed between the spaced-apart flanges, wherein the explosive material is disposed in a center opening of the annular cylinder.

10. The device of claim 9, wherein the annular cylinder has an outside diameter that extends to an inside diameter of the hollow tube.

11. The device of claim 1, wherein one of the first and second sleeves includes a V-shaped groove formed in an end distal the hollow cylindrical tube, and wherein the V-shaped groove configured to mate with a V-shaped projection formed on a bottom interior surface of a COTS one gallon jug.

12. The device of claim 11, wherein the other of the first and second sleeves includes a threaded central opening formed in an end distal the hollow cylindrical tube, and wherein the threaded central opening configured to receive an externally threaded portion of a cable gland.

13. The device of claim 11, further comprising the COTS one gallon jug wherein the hollow tube is vertically disposed in the jug and the V-shaped projection of the jug is disposed in the V-shaped groove of the one of the first and second sleeves, wherein the other of the first and second sleeves includes a threaded central opening formed in an end distal the hollow cylindrical tube, and wherein the threaded central opening configured to receive an externally threaded portion of a cable gland.

14. The device of claim 11, further comprising the COTS one gallon jug, wherein the hollow tube is vertically disposed in the jug and the V-shaped projection of the jug is disposed in the V-shaped groove of the one of the first and second sleeves, wherein the other of the first and second sleeves includes a threaded central opening formed in an end distal the hollow cylindrical tube, and wherein the threaded central opening configured to receive an externally threaded portion of a cable gland;

a cap being fixed to a top opening of the jug, wherein the cable gland extends through the cap and into the threaded central opening of the other of the first and second sleeves; and a length of detonation cord extending from inside one of the pair of spaced-apart flanges, through the central opening of the flange, through the other of the first and second sleeves and through the cable gland to a point that is exterior to the explosive device.

15. The device of claim 11, further comprising the COTS one gallon jug, wherein the hollow tube is vertically disposed in the jug and the V-shaped projection of the jug is disposed in the V-shaped groove of the one of the first and second sleeves, wherein the other of the first and second sleeves includes a threaded central opening formed in an end distal the hollow cylindrical tube, and wherein the threaded central opening configured to receive an externally threaded portion of a cable gland; and a fluid being disposed in the jug, wherein the fluid surrounds the hollow tube.

16. The device of claim 11, further comprising the COTS one gallon jug, wherein the hollow tube is vertically disposed in the jug and the V-shaped projection of the jug is disposed in the V-shaped groove of the one of the first and second sleeves, wherein the other of the first and second sleeves includes a threaded central opening formed in an end distal the hollow cylindrical tube, and wherein the threaded central opening configured to receive an externally threaded portion of a cable gland; and a fluid being disposed in the jug, wherein the fluid surrounds the hollow tube, and wherein the hollow tube extends into a neck portion of the jug.

17. The device of claim 16, further comprising the COTS one gallon jug, wherein the hollow tube is vertically disposed in the jug and the V-shaped projection of the jug is disposed in the V-shaped groove of the one of the first and second sleeves, wherein the other of the first and second sleeves includes a threaded central opening formed in an end distal the hollow cylindrical tube, and wherein the threaded central opening configured to receive an externally threaded portion of a cable gland;

a fluid being disposed in the jug, wherein the fluid surrounds the hollow tube, and wherein the hollow tube extends into a neck portion of the jug; and a blasting cap being connected to the detonation cord at the point exterior to the explosive device.

18. The device of claim 1, wherein each one of the mating pair of semi-cylindrical halves includes a male semi-cylindrical portion and a female semi-cylindrical portion, the male semi-cylindrical portion including a reduced diameter section at one end thereof that is inserted in the female semi-cylindrical portion and the female semi-cylindrical portion including a flange formed on an interior surface thereof which the reduced diameter section of the male portion abuts.

19. The device of claim 18, wherein the explosive material fills an entire volume of the hollow tube between the pair of spaced-apart flanges.

20. The device of claim 18, further comprising one or more hollow spacers disposed in the hollow tube between the pair of spaced-apart flanges wherein the explosive material fills a remaining volume between the pair of spaced-apart flanges.

21. The device of claim 18, further comprising at least one hollow spacer disposed in the hollow tube between the pair of spaced-apart flanges, wherein the explosive material fills a remaining volume between the pair of spaced-apart flanges, and wherein said at least one of the hollow spacer extends an entire length between the pairs of spaced-apart flanges and the explosive material forms an annular cylinder around the hollow spacer.

22. The device of claim 18, further comprising a shock impedance barrier in the form of an annular cylinder disposed between the spaced-apart flanges wherein the explosive material is disposed in a center opening of the annular cylinder.

23. The device of claim 22, wherein the annular cylinder has an outside diameter that extends to an inside diameter of the hollow tube.

24. The device of claim 18, wherein each of the first and second sleeves includes a central opening therein.

25. The device of claim 18, further comprising a COTS five gallon jug, wherein each of the first and second sleeves includes a central opening therein, wherein the hollow tube is vertically disposed in the jug; and a projection on an interior bottom surface of the jug is disposed in the central opening in one of the first and second sleeves.

26. The device of claim 18, further comprising a COTS five gallon jug, wherein each of the first and second sleeves includes a central opening therein, wherein the hollow tube is vertically disposed in the jug;

a projection on an interior bottom surface of the jug being disposed in the central opening in one of the first and second sleeves; and a plug being inserted in a top opening of the jug, the plug includes a cable gland extends through the plug.

27. The device of claim 18, further comprising a COTS five gallon jug, wherein each of the first and second sleeves includes a central opening therein, wherein the hollow tube is vertically disposed in the jug;

a projection on an interior bottom surface of the jug being disposed in the central opening in one of the first and second sleeves;

a plug being inserted in a top opening of the jug, the plug includes a cable gland extends through the plug; and a length of detonation cord extending from inside one of the pair of spaced-apart flanges, through the central opening of the flange, through another of the first and second sleeves and through the cable gland to a point that is exterior to the explosive device.

28. The device of claim 18, further comprising a COTS five gallon jug, wherein each of the first and second sleeves includes a central opening therein, wherein the hollow tube is vertically disposed in the jug;

a projection on an interior bottom surface of the jug being disposed in the central opening in one of the first and second sleeves;

a plug being inserted in a top opening of the jug, the plug includes a cable gland extends through the plug;

a length of detonation cord extending from inside one of the pair of spaced-apart flanges, through the central opening of the flange, through another of the first and second sleeves and through the cable gland to a point that is exterior to the explosive device; and a fluid being disposed in the jug wherein the fluid surrounds the hollow tube.

29. The device of claim 28, further comprising a COTS five gallon jug, wherein each of the first and second sleeves includes a central opening therein, wherein the hollow tube is vertically disposed in the jug;

a projection on an interior bottom surface of the jug being disposed in the central opening in one of the first and second sleeves;

a plug being inserted in a top opening of the jug, the plug includes a cable gland extends through the plug;

a length of detonation cord extending from inside one of the pair of spaced-apart flanges, through the central opening of the flange, through another of the first and second sleeves and through the cable gland to a point that is exterior to the explosive device;

a fluid being disposed in the jug wherein the fluid surrounds the hollow tube; and a blasting cap connected to the detonation cord at the point exterior to the explosive device.

30. The device of claim 18, further comprising a COTS five gallon jug, wherein each of the first and second sleeves includes a central opening therein, wherein the hollow tube is vertically disposed in the jug;

a projection on an interior bottom surface of the jug being disposed in the central opening in one of the first and second sleeves;

a plug being inserted in a top opening of the jug, the plug includes a cable gland extends through the plug;

a length of detonation cord extending from inside one of the pair of spaced-apart flanges, through the central opening of the flange, through another of the first and second sleeves and through the cable gland to a point that is exterior to the explosive device; and a fluid being disposed in the jug, wherein the fluid surrounds the hollow tube, and wherein the hollow tube extends into a neck portion of the jug such that a bottom surface of the plug exerts a compressive force on a top surface of the tube.

31. The device of claim 18, further comprising a COTS five gallon jug, wherein each of the first and second sleeves includes a central opening therein, wherein the hollow tube is vertically disposed in the jug;

a projection on an interior bottom surface of the jug being disposed in the central opening in one of the first and second sleeves;

a plug being inserted in a top opening of the jug, the plug includes a cable gland extends through the plug;

a length of detonation cord extending from inside one of the pair of spaced-apart flanges, through the central opening of the flange, through another of the first and second sleeves and through the cable gland to a point that is exterior to the explosive device;

a fluid being disposed in the jug, wherein the fluid surrounds the hollow tube, and wherein the hollow tube extends into a neck portion of the jug such that a bottom surface of the plug exerts a compressive force on a top surface of the tube; and a cap being configured for closing the top portion of the jug.

32. The device of claim 1, wherein each one of the mating pair of semi-cylindrical halves includes a male semi-cylindrical portion and a female semi-cylindrical portion, the male semi-cylindrical portion including a reduced diameter section at one end thereof that is inserted in the female semi-cylindrical portion and the female semi-cylindrical portion including a flange formed on an interior surface thereof against which the reduced diameter section of the male portion abuts, and wherein the opposing ends have external threads that engage internal threads of respective ones of the first and second sleeves.

33. The device of claim 1, wherein each one of the mating pair of semi-cylindrical halves includes a male semi-cylindrical portion and a female semi-cylindrical portion, the male semi-cylindrical portion including a reduced diameter section at one end thereof that is inserted in the female semi-cylindrical portion and the female semi-cylindrical portion including a flange formed on an interior surface thereof against which the reduced diameter section of the male portion abuts, and wherein the first and second sleeves form a friction fit with the opposing ends.

34. A method, comprising:

providing the device of claim 1;

placing the explosive material in the separated semi-cylindrical halves;

providing a length of detonation cord, forming a knot in one end of the detonation cord and placing the knot on an interior side of one of the pair of spaced-apart flanges;

placing the length of detonation cord in the central opening in the one of the spaced-apart flanges and through one of the first and second sleeves to a point that is exterior to the explosive device; and joining the mating pair of semi-cylindrical halves together and placing the first and second sleeves over the lesser diameter opposing ends of the tube.

35. The method of claim 34, further comprising placing the device in a hole in the ground, attaching a blasting cap to a second end of the detonation cord and activating the device by initiating the blasting cap.

36. The method of claim 34, further comprising filling a one gallon COTS jug with water, placing the device vertically in the jug so that the hollow tube is disposed in the neck portion of the jug, feeding the detonation cord through a cable gland disposed in a jug cap and closing the jug with the jug cap.

37. The method of claim 36, further comprising placing the device near a target; attaching a blasting cap to a second end of the detonation cord; and activating the device by initiating the blasting cap, wherein the blasting cap is located outside of the jug.

38. The method of claim 34, further comprising placing the device underwater near an underwater target; attaching a blasting cap to a second end of the detonation cord, wherein the second end is located near a surface of the water; and activating the device by initiating the blasting cap.

39. The method of claim of claim 34, further comprising filling a five gallon COTS jug with water; placing the device vertically in the jug so that the hollow tube is disposed in the neck portion of the jug; feeding the detonation cord through a cable gland disposed in a plug in the neck portion of the jug; and closing the jug with a jug cap.

40. The method of claim 39, further comprising placing the device near a target; attaching a blasting cap to a second end of the detonation cord; and activating the device by initiating the blasting cap, wherein the blasting cap is located outside of the jug.

41. An explosive device, comprising:

a hollow member being formed of a mating pair of halves, wherein the hollow member includes opposing ends and includes a pair of spaced-apart flanges formed on an interior surface thereof, wherein each of the pair of spaced-apart flanges includes a central opening therein, and wherein the hollow member includes first and second sleeves disposed over the opposing ends of the member to thereby hold the mating halves together;

an explosive material being disposed in the hollow member; and a length of detonation cord extending from inside one of the pair of spaced-apart flanges, through the central opening of the one of the pair of flanges and through one of the first and second sleeves to a point that is exterior to the explosive device.

42. The device of claim 41, wherein the explosive material is at least one of C-4, and flexible rubberized explosive.

43. The device of claim 41, wherein the hollow member is an hourglass shaped hollow member.

44. The device of claim 43, further comprising a length of detonation cord extending from inside one of the pair of spaced-apart flanges, through the central opening and through one of the first and second sleeves to a point that is exterior to the explosive device.

45. The device of claim 43, further comprising a fluid-filled container, wherein the hollow member is disposed in the fluid-filled container.

46. The device of claim 45, further comprising a fluid-filled container, wherein the hollow member is disposed in the fluid-filled container, wherein the fluid-filled container has a cylindrical shape, and wherein the fluid-filled container has an hourglass shape.

47. The device of claim 43, further comprising a fluid-filled container, wherein the hollow member is disposed in the fluid-filled container, and wherein the fluid-filled container has a cylindrical shape.

48. The device of claim 41, further comprising a blasting cap being connected to the detonation cord at the point.

49. The device of claim 41, wherein the opposing ends have external threads that engage internal threads of respective ones of the first and second sleeves.

50. The device of claim 41, wherein the first and second sleeves form a friction fit with the opposing ends.

51. The device of claim 41, wherein the hollow member has a cylindrical shape, wherein the device further comprises a fluid-filled container having an hourglass shape, and wherein the hollow member is disposed in the fluid-filled container.

52. An explosive device, comprising:

a hollow cylindrical tube having a mating pair of semi-cylindrical halves, wherein the hollow cylindrical tube includes opposing ends of lesser outside diameter than an outside diameter of the remainder of the tube, wherein the hollow cylindrical tube includes a pair of spaced-apart flanges formed on an interior surface thereof, each flange including a central opening therein, and wherein the hollow cylindrical tube includes first and second sleeves disposed over the lesser diameter opposing ends of the tube to hold the semi-cylindrical halves together; and a length of detonation cord being disposed in the hollow cylindrical tube between the pair of spaced-apart flanges, wherein said length of said detonation cord extends from inside one of the pair of spaced-apart flanges, through the central opening of the one of the pair of flanges and through one of the first and second sleeves to a point that is exterior to the explosive device.

* * * * *